US006484817B2

(12) United States Patent
Innes

(10) Patent No.: US 6,484,817 B2
(45) Date of Patent: Nov. 26, 2002

(54) SIGNALING SYSTEM FOR DRILLING

(75) Inventor: Frank Innes, Dyce (GB)

(73) Assignee: Geolink (UK) LTD, A UK Limited Liability Company (GB)

( * ) Notice: Subject to any disclaimer, the term of this patent is extended or adjusted under 35 U.S.C. 154(b) by 0 days.

(21) Appl. No.: 09/811,841

(22) Filed: Mar. 19, 2001

(65) Prior Publication Data

US 2002/0008634 A1 Jan. 24, 2002

(30) Foreign Application Priority Data

Mar. 29, 2000 (GB) ..... 0007555

(51) Int. Cl.[7] ..... E21B 25/16

(52) U.S. Cl. ..... 175/45; 175/48; 367/85

(58) Field of Search ..... 166/254.2; 175/25, 175/40, 45, 48; 340/853.1, 853.2, 853.3; 367/83, 85

(56) References Cited

U.S. PATENT DOCUMENTS

| | | | | | |
|---|---|---|---|---|---|
| 3,958,217 | A | | 5/1976 | Spinnler | 340/18 LD |
| 4,699,352 | A | | 10/1987 | Mumby | 251/30.03 |
| 4,905,778 | A | * | 3/1990 | Jurgens | 166/320 |
| 4,914,637 | A | | 4/1990 | Goodsman | 367/83 |
| 5,040,155 | A | | 8/1991 | Feld | 367/85 |
| 5,103,430 | A | | 4/1992 | Jeter et al. | 367/85 |
| 5,740,127 | A | * | 4/1998 | Van Steenwyk et al. | 175/40 |

* cited by examiner

*Primary Examiner*—William Neuder
*Assistant Examiner*—Brian D. Halford
(74) *Attorney, Agent, or Firm*—Madson & Metcalf

(57) ABSTRACT

A pressure pulse generator for use in transmitting pressure signals to surface in a fluid-based drilling system. The generator is arranged in use in the path of a pressurized fluid to operate a drilling assembly and is capable of being actuated to generate pressure signals in such fluid for transmission to surface pressure monitoring equipment. The pulse generator includes pulse height compensation to keep the pulse height within acceptable limits over a wide flow range.

14 Claims, 4 Drawing Sheets

SIGNALING SYSTEM FOR DRILLING

This invention relates to a system of communication employed during the drilling of boreholes in the earth for purposes such as oil or gas exploration and production, the preparation of subterranean services ducts, and in other civil engineering applications.

BACKGROUND TO INVENTION

Taking the drilling of oil and gas wells as an example, it is highly desirable both for economic and for engineering reasons, to obtain information about the progress of the borehole and the strata which the drilling bit is penetrating from instruments positioned near the drilling bit, and to transmit such information back to the surface of the earth without interruption to the drilling of the borehole. The generic name associated with such techniques is "Measurement-while-Drilling" (MWD). Substantial developments have taken place in MWD technology during the last twenty-five years.

One of the principal problems in MWD technology is that of reliably telemetering data from the bottom of a borehole, which may lie several thousand meters below the earth's surface. There are several established methods for overcoming this problem, one of which is to transmit the data, suitably encoded, as a series of pressure pulses in the drilling fluid; this method is known as "mud pulse telemetry".

DESCRIPTION OF PRIOR ART

A typical arrangement of a known mud pulse MWD system is shown schematically in FIG. 1. A drilling rig (50) supports a drillstring (51) in the borehole (52). Drilling fluid, which has several important functions in the drilling operation, is drawn from a tank (53) and pumped, by pump (54) down the center of the drillstring (55) returning by way of the annular space (56) between the drillstring and the borehole (52). The MWD equipment (58) that is installed near the drill bit (59) includes a means for generating pressure pulses in the drilling fluid. The pressure pulses travel up the center of the drillstring and are received at the earth's surface by a pressure transducer (57). Processing equipment (60) decodes the pulses and recovers the data that was transmitted from downhole.

In one means of generating pressure pulses at a downhole location, the fluid flowpath through the drillstring is transiently restricted by the operation of a valve. This creates a pulse, the leading edge of which is a rise in pressure; hence the method is colloquially, although rather loosely, known as "positive mud pulse telemetry". In contradistinction the term "negative mud pulse telemetry" is used to describe those systems in which a valve transiently opens a passage to the lower pressure environment outside the drill string, thus generating a pulse having a falling leading edge.

Devices for generating pulses for positive mud pulse telemetry have been described in, for example, U.S. Pat. Nos. 3,958,217, 4,905,778, 4,914,637 and 5,040,155.

The present invention is related generally to the type of mud pulse generator described in U.S. Pat. No. 3,958,217. It is a disadvantage of this type of pulse generator that the magnitude of the transient pressure change which occurs downhole is highly dependent on the flowrate of the drilling fluid.

The pressure drop when fluid flows through a restriction varies approximately as the square of the flow rate. Typically, the ratio of maximum to minimum flow rates in an oilwell drilling situation is around three, so a pulse generator set up to give an acceptable pulse height of around 7 bar at minimum flow of a particular drilling mud formulation would give 63 bar at maximum flow. In practice, drilling mud is formulated with a wide range of densities and viscosities, so the potential variation in pulse height across the flow range is considerably greater.

Although in any given drilling situation a certain minimum pulse amplitude is needed so that the pulse will be detectable at the earth's surface, it is unsatisfactory for the pulse to be made too large: the imposition of a succession of severe flow restrictions can stress, damage or erode the drilling equipment and starve the drilling bit of fluid. Furthermore, when mud pressure pulses are too large, significant pulse reflections occur at discontinuities in the process pipework. In particular a pulse can return to the lower end of the drillstring, be reflected, return to surface and be detected, incorrectly, as a data pulse.

In order to keep pulse heights within acceptable limits, the pulse generator has to be physically adjusted to suit a particular combination of flow rate and mud type. This typically involves replacing parts of the downhole system, and is time consuming and expensive. There are cases too, in which for unexpected reasons, the planned flowrates for a particular well section have to be changed while the equipment is downhole. It is therefore very desirable to provide a single system which will operate satisfactorily over a wide range of drilling fluid flowrates.

The invention seeks to obtain this advantage by providing a means of automatic pulse height regulation in the fluid used in a drilling installation.

SUMMARY OF INVENTION

According to the invention there is provided a pressure pulse generator for use in transmitting pressure signals to surface in a fluid-based drilling system, said generator being arranged in use in the path of a pressurised fluid to operate a drilling assembly and being capable of being actuated to generate pressure signals in such fluid for transmission to surface pressure monitoring equipment, in which the pulse generator comprises:

- a housing positionable in the path of the supply of pressurised fluid, said housing having an inlet arrangement for admitting a portion of the fluid to the interior of the housing, and an outlet arrangement for discharging fluid from the interior of the housing;
- a control element slidably mounted in the housing for movement between an open position and a closed position with respect to said inlet arrangement, said control element being operative to generate a pressure pulse in the supply of pressure fluid when the control element takes-up the closed position;
- a control passage for receiving a portion of the supply of pressure fluid and extending through the control element, and having an inlet at one end to receive pressure fluid and a discharge outlet at an opposite end;
- a valve element arranged to be exposed to the pressure of the fluid in the control passage;
- an actuator coupled with the valve element and operative to move the valve element between a closed position in which it prevents discharge of pressure fluid from the control passage, and an open position in which it allows the pressure fluid to flow through the control passage;
- a control face on the control element which is exposed to the pressure of the fluid in the control passage and which is operative to move the control element towards the closed position with respect to the inlet arrangement as the pressure in the control passage increases upon movement of the valve element to the closed position by the actuator; and, a resiliently yieldable arrangement acting between the actuator and the valve element in order to define a yieldable limit to the pressure of the fluid in the control passage and thereby control the pressure pulse generated by the movement of the control element to the closed position.

DESCRIPTION OF PREFERRED EMBODIMENTS

Figure 1:
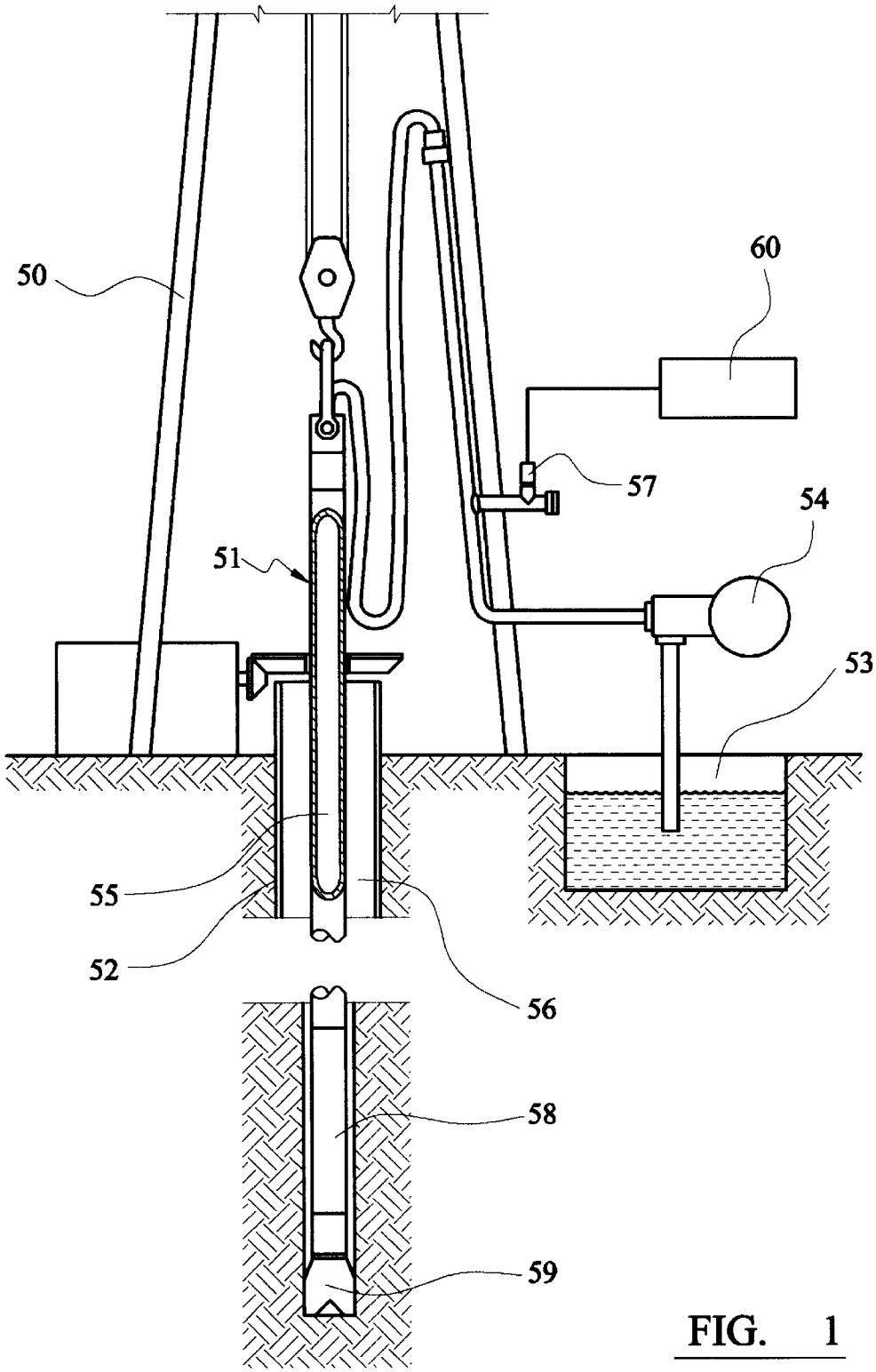
FIG. 1 PRIOR ART
FIG. 1 is a schematic illustration of a known MWD system to which the invention may be applied.
Figure 2:
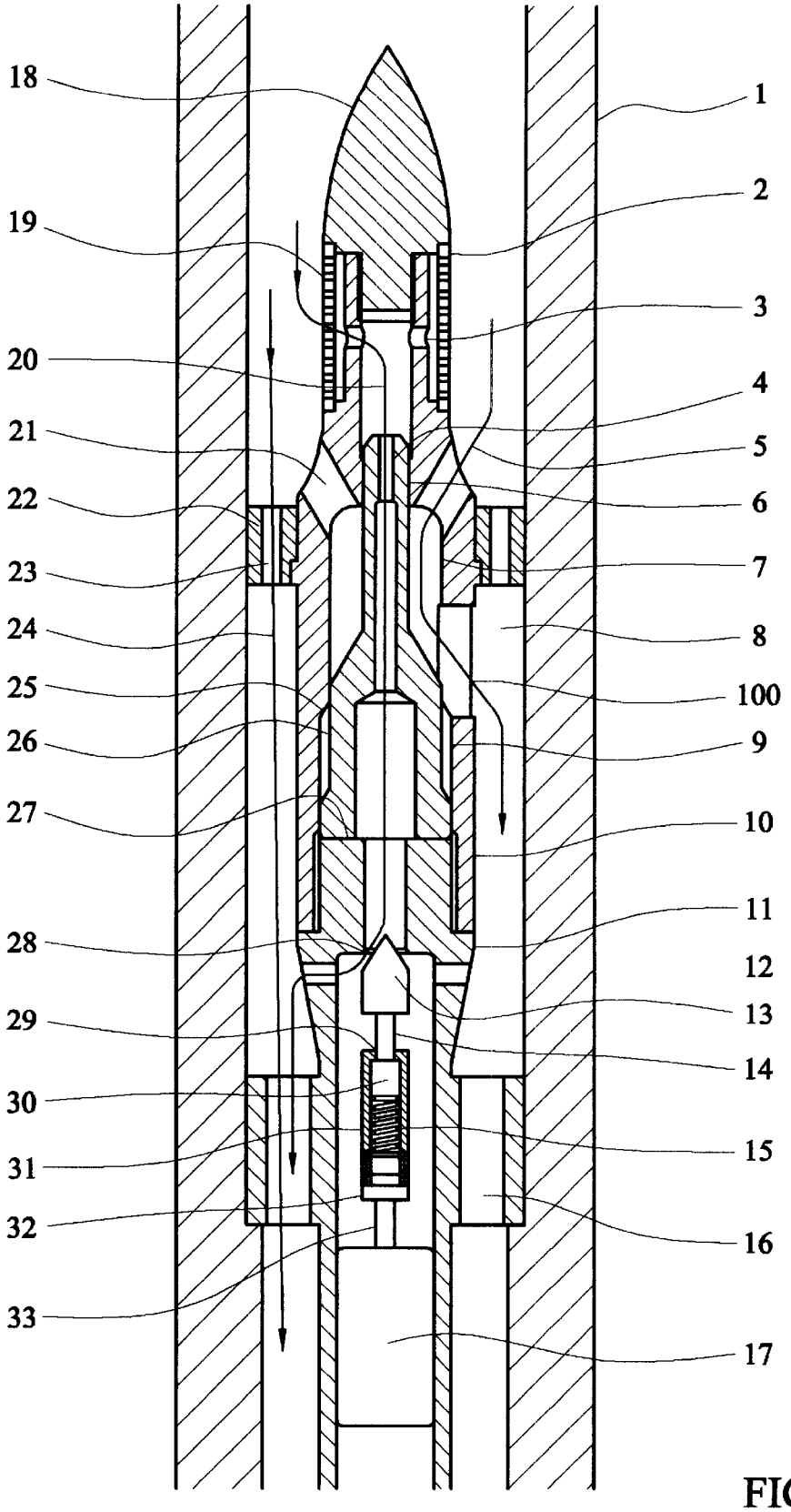
FIG. 2 is a longitudinal sectional view of a pressure pulse generator according to the invention, located downhole and in the path of a pressurised flow of fluid (mud) to operate a drill located below the pulse generator, and showing the generator in an inoperative mode, allowing throughflow passage of the fluid, without generating any pressure pulse signals to surface.

FIG. 2 shows a mud pulse generator, designated generally by reference 100, and mounted in a drill collar (1). The pulse generator is generally of the type described in U.S. Pat. No. 3,958,217, in which the energy needed to operate the restricting valve is derived from the drilling fluid. Drilling fluid flows down through the space and passages in the bore of drill collar (1), on through a drilling motor (if fitted) and thence to the drill bit (not shown). The drilling fluid returns upwards in the annular space between the outside of the drill collar (1) and the rock formation being penetrated (not shown). In a typical installation the fluid is "drilling mud". However, other fluids may be used, including gas, foam or mist.

A housing is positioned in the path of the pressurised drilling fluid and comprises a body (10), located inside the drill collar (1) and having three different internal bores (6), (7) and (9).

A control element in the form of piston (26) is a sliding fit in these bores. Its upward travel is limited by the face (25) at the upper end of the largest bore (9). Its downward travel is limited by the face (27) of the mounting (11).

Inlet and outlet arrangements comprise inlet orifices (21) and exit orifices (8) provided in the body (10). Mud can flow along the path (5) through these orifices except when the piston (26) is in the fully forward (upward) position.

A screen (2) perforated by holes or slots (19) is retained at the front of the body (10) by a nose cone (18). Drilling fluid can normally flow also along a control passage comprising second path (20) through the screen holes (19), ports (3) in the body (10), and a central bore (4) in the piston (26). The dimensions of the holes or slots (19) are chosen to prevent blockage of the central bore (4) by mud particles.

A valve element (13) connected to an actuator (17) is normally held clear of its seat (28) in the mounting (11) to permit flow along the path (20) past the valve element (13) and out through ports (12) in the mounting (11).

A fixed restrictor (22) supporting the front of the body (10) contains ports (23) to provide a third flow path (24) outside the body. The mounting (11) has ports (16) to permit flow to continue down the drill collar.

The basic operation of the pulse generator will now be described.

FIG. 2 shows the pulse generator in the normal, off pulse condition. Drilling fluid flows along the three paths (5), (20) and (24). The pressure upstream of the restrictor (22) is higher than that downstream because of the throttling effect of the restrictor (22) on the mud flow. The piston (26) is held in the rearward (bottom) position by flow forces and by the differential pressure created by the restrictor (22).

To initiate a pulse, the valve (13) is closed by the actuator (17). High pressure flow from the region upstream of the restrictor (22) transmitted along path (20) now builds up between the piston (26) and the face (27) of the mounting (11). The area of face (27) is greater than the area of the piston in bore (6) which is directly exposed to the upstream pressure. The net force on the piston (26) is now in the upwards direction and the piston moves upwards until its travel is stopped by contact with face (25).

Figure 3:
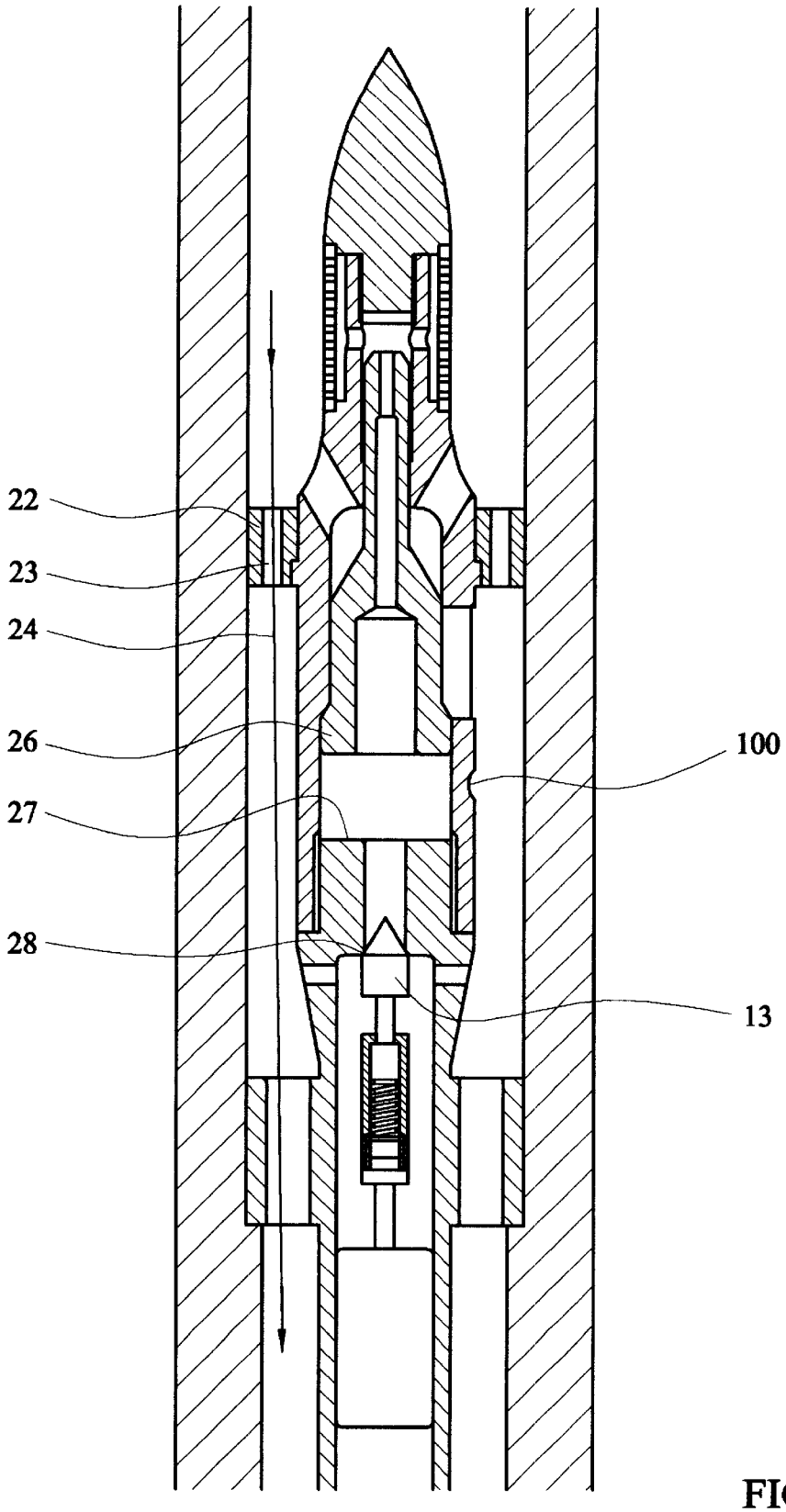
FIG. 3 is a view, similar to FIG. 2, but showing the movement of the internal components of the generator to a pressure signal transmitting mode, after actuation of the generator to block throughflow of fluid; and, FIG. 4 is a view, similar to FIGS. 2 and 3, but showing the internal components in a partly closed position, whereby to reduce, when necessary, the magnitude of the pressure of the signaling pulse generated.
Figure 4:
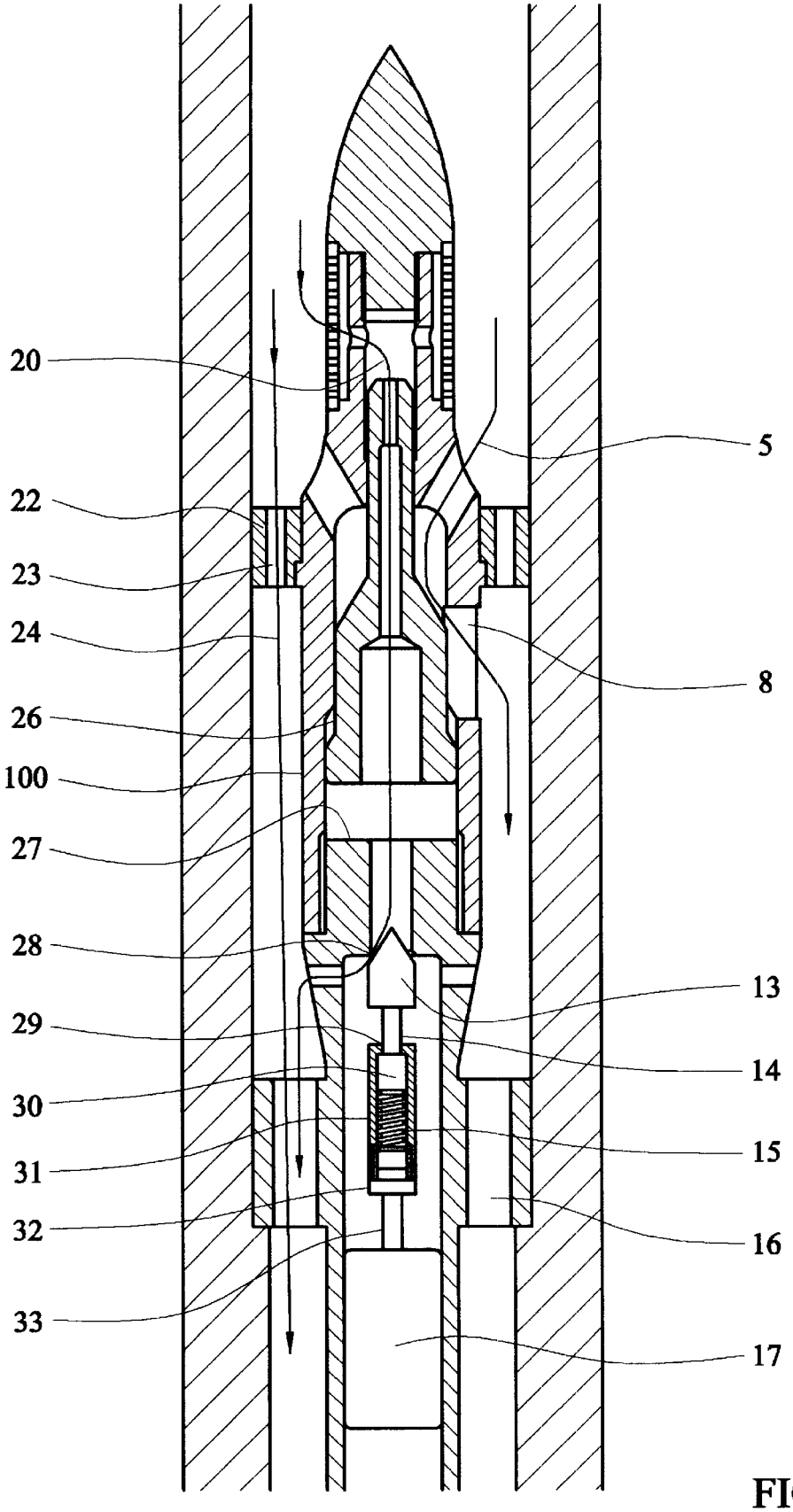

FIG. 3 shows the piston (26) in the fully forward position with the valve (13) still closed. Flow is now only along path (24), and the pressure drop across the pulse generator is entirely determined by the area of the restrictor ports (23), the mud flow rate, density and viscosity. This pressure drop will be maintained for as long as the valve (13) is held on the seat (28).

To return to the initial conditions as shown in FIG. 2, the valve (13) is withdrawn from the seat (28) by the actuator (17) e.g. by de-energising of the actuator (17). Pressure behind the piston (26) is released, so that the net force on the piston is once again in the downwards direction. The piston (26) moves back to its original position under the influence of this downwards force, assisted by flow forces once the exit orifices (8) start to re-open.

It can be seen that with the valve (13) fully in contact with the seat (28), the only way of altering the on-pulse pressure drop would be to change the area of the ports (23) in the restrictor (22).

A particularly advantageous further feature of the pulse generator will now be described, and its mode of operation.

A resilient biasing arrangement acts between the valve (13) and the actuator (17), and in the illustrated embodiment takes the form of a spring 15 (or other compliant element). The spring (15) is contained in a housing (31) and acts against an increased diameter section (30) of the rod (14) connected to the valve (13). Movement of the rod (14) is limited by a reduced diameter (29) at the upstream end of the housing (31). The housing is attached to the output rod (33) of the actuator (17) by a coupling (32) which also provides the rear abutment for the spring (15).

When the actuator (17) is operated to initiate a pulse, the valve (13) is forced against the seat (28) through the intermediary of the spring (15). The piston (26) moves forward as previously described, and as it does so, the flow along path (5) is increasingly throttled as the exit orifices (8) are blanked off by the piston.

The resultant increased pressure drop across the pulse generator is transmitted along path (20) to the valve (13). If the pressure drop becomes sufficiently high to overcome the spring force, the valve (13) is forced off the seat (28) and a certain amount of flow is re-established along path (5). A situation is reached as shown in FIG. 2 where the forces on the piston (26) and the valve rod (14) are in equilibrium. The piston (26) and the valve stem (13) are in intermediate positions, and the pressure drop across the mud pulse generator is therefore determined by the characteristics of the spring (15).

With a suitable choice of stiffness and initial compression, the pulse height can be kept within acceptable limits over a wide flow range.

The restrictor (22) may be changed to keep the flow rate along path (5) within the control range of the spring (15) if a major change in total flow rate is to occur.

In a preferred embodiment, the parts of the pulse generator are made from materials suitable for the environment of deep drilling operations. As is well-known to those who work in this field, materials such as beryllium-copper and stainless steel are suitable materials for parts of the system which contact the drilling fluid. In regions of the system where fluid velocities are high, it is preferable to employ especially hard material, such as tungsten carbide, for good resistance to fluid erosion. The actuator (17) is a conventional electromagnetic solenoid. It is well-known, and good practice, to isolate items such as the actuator (17), the spring (15) and the associated parts, from direct contact with the drilling fluid. This is typically done by employing resilient seals to provide isolation and then filling the space so enclosed with a light hydraulic oil. These details have been omitted from the drawings for clarity.

Using a mud pulse generator with pulse height compensation built according to this invention, tests were carried out using a flow loop to determine the efficacy of the pulse height compensation. The following results were obtained in a representative test.

| Drilling fluid flow rate (US gallons per minute) | Height of pressure pulse in the absence of compensation (bar) | Height of pressure pulse with compensation (bar) |
|---|---|---|
| 200 | 6.6 | 6.9 |
| 300 | 14.4 | 7.3 |
| 400 | 28.3 | 7.6 |
| 500 | * | 6.9 |
| 600 | * | 7.7 |

*FIGS. for the uncompensated pulse height at 500 and 600 USGPM were not obtained because of limitations of the test equipment

I claim:

1. A pressure pulse generator for use in transmitting pressure signals to surface in a fluid-based drilling system, said generator being arranged in use in the path of a pressurized fluid to operate a drilling assembly and being capable of being actuated to generate pressure signals in such fluid for transmission to surface pressure monitoring equipment, in which the pulse generator comprises:

a housing positionable in the path of the supply of pressurized fluid, said housing having an inlet arrangement for admitting a portion of the fluid to the interior of the housing, and an outlet arrangement for discharging fluid from the interior of the housing;

a control element slidably mounted in the housing for movement between an open position and a closed position with respect to said inlet arrangement, said control element being operative to generate a pressure pulse in the supply of pressure fluid when the control element takes-up the closed position;

a control passage for receiving a portion of the supply of pressure fluid and extending through the control element, and having an inlet at one end to receive pressure fluid and a discharge outlet at an opposite end;

a valve element arranged to be exposed to the pressure of the fluid in the control passage;

an actuator coupled with the valve element and operative to move the valve element between a closed position in which it prevents discharge of pressure fluid from the control passage, and an open position in which it allows the pressure fluid to flow through the control passage;

a control face on the control element which is exposed to the pressure of the fluid in the control passage and which is operative to move the control element towards the closed position with respect to the inlet arrangement as the pressure in the control passage increases upon movement of the valve element to the closed position by the actuator; and, a resiliently yieldable arrangement acting between the actuator and the valve element in order to define a yieldable limit to the pressure of the fluid in the control passage and thereby control the pressure pulse generated by the movement of the control element to the closed position.

2. A pressure pulse generator according to claim 1, in which the resiliently yieldable arrangement comprises a compression spring.

3. A pressure pulse generator according to claim 2, in which the actuator is coupled with the valve element via a valve housing in which the compression spring is arranged, and which spring acts between the actuator and an actuator rod slidably mounted in a valve housing and coupled at one end with said valve element.

4. A pressure pulse generator according to claim 3, in which the actuator is electromagnetically operable.

5. A pressure pulse generator according to claim 2, in which the actuator is electromagnetically operable.

6. A pressure pulse generator according to claim 5, in which the housing has external ports, which allow by-pass flow of the supply of pressurized fluid.

7. A pressure pulse generator according to claim 6, in which at least one of the external ports is replaceably mounted, to allow a replacement port to be installed having a different pressure restriction and thereby to adjust the pressure of fluid passing to the interior of the housing when a major change in flowrate of the pressurized fluid is to occur.

8. A pressure pulse generator according to claim 2, in which the housing has external ports, which allow by-pass flow of the supply of pressurized fluid.

9. A pressure pulse generator according to claim 8, in which at least one of the external ports is replaceably mounted, to allow a replacement port to be installed having a different pressure restriction and thereby to adjust the pressure of fluid passing to the interior of the housing when a major change in flowrate of the pressurized fluid is to occur.

10. A pressure pulse generator according to claim 1, in which the actuator is electromagnetically operable.

11. A pressure pulse generator according to claim 10, in which the housing has external ports, which allow by-pass flow of the supply of pressurized fluid.

12. A pressure pulse generator according to claim 11, in which at least one of the external ports is replaceable mounted, to allow a replacement port to be installed having a different pressure restriction and thereby to adjust the pressure of fluid passing to the interior of the housing when a major change in flowrate of the pressurized fluid is to occur.

13. A pressure pulse generator according to claim 1, in which the housing has external ports, which allow by-pass flow of the supply of pressurized fluid.

14. A pressure pulse generator according to claim 13, in which at least one of the external ports is replaceable mounted, to allow a replacement port to be installed having a different pressure restriction and thereby to adjust the pressure of fluid passing to the interior of the housing when a major change in flowrate of the pressurized fluid is to occur.

* * * * *